United States Patent [19]

Orosy et al.

[11] Patent Number: 5,025,928

[45] Date of Patent: Jun. 25, 1991

[54] TRAVEL CASE

[75] Inventors: Gary D. J. Orosy, Franklin, Mass.; Frederick B. Hadtke, New Providence, N.J.; Paul D. Miller, New York, N.Y.

[73] Assignee: The Gillette Company, Boston, Mass.

[21] Appl. No.: 602,218

[22] Filed: Oct. 22, 1990

[51] Int. Cl.[5] ..... B65D 69/00

[52] U.S. Cl. ..... 206/581; 383/11; 206/810

[58] Field of Search ..... 206/581, 810; 383/11, 383/13, 14, 19, 24, 25, 28

[56] References Cited

U.S. PATENT DOCUMENTS

| | | | |
|---|---|---|---|
| 818,412 | 4/1906 | Byrne . | |
| 1,181,506 | 5/1916 | Cunningham | 383/11 |
| 1,214,282 | 1/1917 | Day | 206/581 |
| 1,578,778 | 3/1926 | Thornhill | 206/581 |
| 1,867,347 | 7/1932 | Blair . | |
| 2,038,319 | 4/1936 | Stanley . | |
| 2,167,926 | 8/1939 | Glasker | 206/581 |
| 2,293,319 | 8/1942 | Beehler . | |
| 3,051,130 | 8/1962 | Morris | 383/11 |
| 3,141,486 | 7/1964 | Bosca et al. | 206/581 |
| 3,726,329 | 4/1973 | Dean . | |
| 3,955,728 | 5/1976 | Jackson . | |
| 4,339,061 | 7/1982 | Dunn . | |
| 4,548,375 | 10/1985 | Moss | 383/11 |
| 4,917,160 | 4/1990 | Hart . | |

FOREIGN PATENT DOCUMENTS

| | | | |
|---|---|---|---|
| 3435023 | 4/1986 | Fed. Rep. of Germany | 206/581 |
| 520030 | 6/1921 | France | 206/581 |
| 524689 | 8/1940 | United Kingdom | 206/581 |
| 586898 | 4/1947 | United Kingdom | 206/581 |

*Primary Examiner*—William I. Price
*Attorney, Agent, or Firm*—Fish & Richardson

[57] ABSTRACT

A travel case includes a base portion that defines a first compartment with organizer structure therein, and support structure for securing the travel case on a support bar or the like, the organizer structure having a plurality of chambers for receiving toiletry components of diverse shapes and sizes in frictionally secured relation. The case also has a cover portion that defines a second compartment with releasable strap structure for securing a shaving system that includes a razor handle and a storage member that carries a plurality of razor cartridges against the inner surface of the top wall of the cover. Hinge structure that connects the rear wall of the base portion and the rear wall of the cover portion allows convenient accessibility to the razor and toiletry components when the case is open, and closure structure holds corresponding surfaces of the base and cover portions in juxtaposed relation when the case is closed.

20 Claims, 3 Drawing Sheets

TRAVEL CASE

This invention relates to accessory bags, and more particularly to travel cases for safety razors, toilet articles and the like.

In accordance with one aspect of the invention, there is provided a travel case that includes a base portion that defines a first compartment with organizer structure therein, the organizer structure having a plurality of chambers for receiving toiletry components of diverse shapes and sizes in frictionally secured relation, and support structure for securing the travel case on a support bar or the like. The case also has a cover portion that defines a second compartment with releasable structure for securing a shaving system that includes a razor handle and a storage member that carries a plurality of razor cartridge against the inner surface of the top wall of the cover. Hinge structure connects the rear wall of the base portion and the rear wall of the cover portion and allows convenient accessibility to the razor and toiletry components when the case is open, and closure structure holds corresponding surfaces of the base and cover portions in juxtaposed relation when the case is closed.

Preferably, the support structure in the base portion and the retaining structure in the cover portion each includes a strap member and hook and loop fastener structure for releasable securing the strap member in attached relation. The securing structure in the cover portion retains a cartridge storage tray of the type shown in Aprille U.S. Pat. No. 4,742,909 that stores razor blade assemblies of the type shown in Jacobson Design Patent No. 290,050; and the storage tray also frictionally retains a razor handle of the type shown in Jacobson U.S. Pat. No. 4,492,025, the disclosures of which are expressly incorporated herein by reference. The securing straps in the cover portion have a first configuration in which both the razor handle and the storage tray are retained and a second configuration in which only the storage tray is retained by the straps.

In a particular embodiment, the organizer structure is removable from the base portion and includes spaced, generally parallel front and rear planar portions and spaced transverse portions that interconnect the front and rear portions, the spaced transverse portions providing a first compartment for receiving a first toiletries article therebetween and each transverse portion including at least one further compartment for receiving second and third toiletries articles different from the first toiletries article. Each of the front and rear planar portions also include at least one compartment for receiving a further toiletries article of shape different from the first, second and third toiletries articles. The base portion has a generally rectangular bottom wall, spaced generally parallel side walls, a front wall and a rear wall; the cover portion also has a generally rectangular top wall, spaced generally side walls corresponding to the side wall portions of the base portion, a front wall, and a rear wall; and the side walls and front wall of the base portion have upper surfaces that correspond to lower surfaces of the side walls and front wall of the cover portion. The rear wall of the cover portion includes zipper closed compartment structure for receiving a toiletries article or the like. The top surfaces of the side walls of the base portion are inclined at an angle of greater than 30°, and the height of the front wall of the cover portion is less than about three centimeters so that the razor secured in the cover portion is readily accessible for removal and use when the case is open. In that particular embodiment, the bottom wall has a length of about twenty centimeters and a width of about eight centimeters; and the back wall portions of the base and cover portions are generally aligned in closed configuration, the overall height of the aligned back wall portions being about seventeen centimeters.

The travel case provides efficient and organized storage of a shaving system and a variety of toiletries articles, as well as convenient accessibility for use.

Other features and advantages of the invention will be seen as the following description of a particular embodiment progresses, in conjunction with the drawing, in which.

Description of Particular Embodiment

Figure 1:
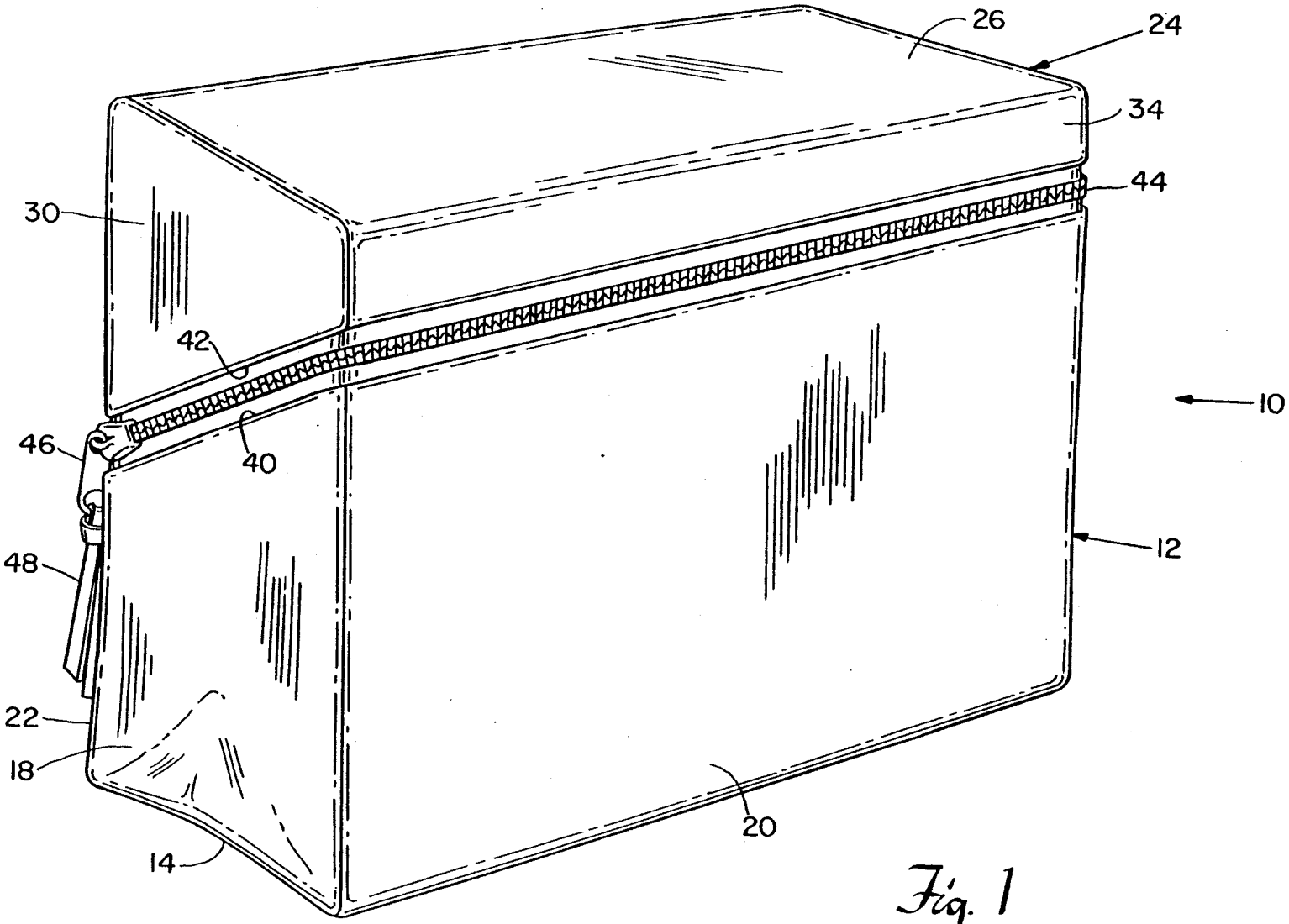
FIG. 1 is a perspective view of a travel case in accordance with the invention.

The travel case 10 shown in FIG. 1 includes base portion 12 that has generally rectangular bottom wall 14, generally parallel side walls 16, 18, front wall 20 and rear wall 22; and cover portion 24 that has rectangular top wall portion 26, spaced parallel side walls 28, 30, rear wall 32, and front wall 34. Case 10 has a width of about twenty centimeters, a depth of about eight centimeters and an overall height of about seventeen centimeters. The height of front wall 20 of base portion 12 is about fourteen centimeters and the height of front wall 34 of cover portion 24 is about two centimeters while the heights of back wall portions 22 are equal, each about eight centimeters and are joined by hinge structure 36, 38. The top surfaces 40 of side walls 16, 18 slant upwardly at an angle of about 37° to the plane of base 14 and are disposed in juxtaposed relation with correspondingly inclined surfaces 42 of top portion 24 when case 10 is closed. Zipper closure 44 that is controlled by slider 46 and pull tab 48 secures the corresponding inclined surfaces 40, 42 in juxtaposed relation, together with corresponding surfaces of front walls 20 and 34, respectively.

Figure 2:
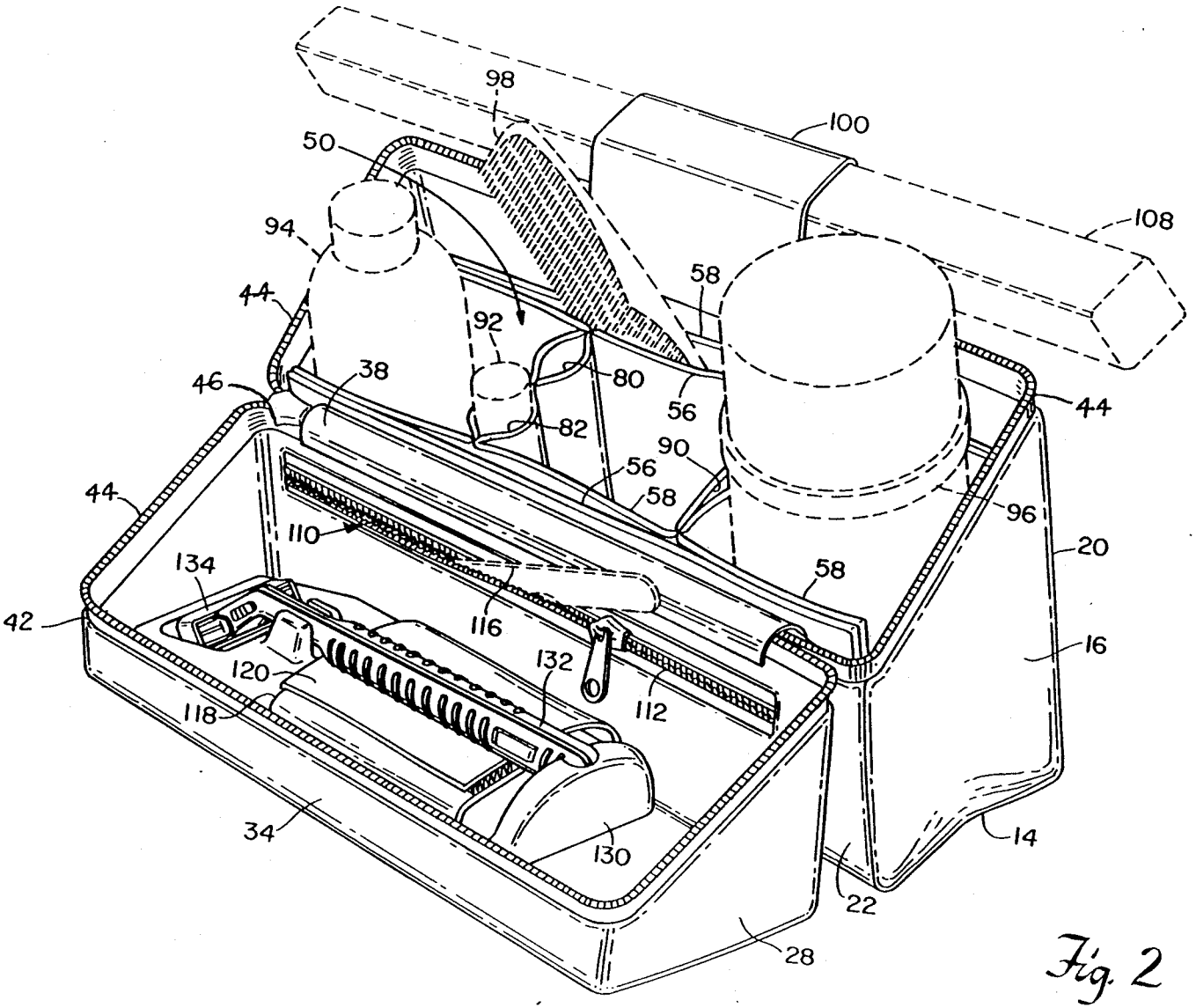
FIG. 2 is a perspective view of the travel case of FIG. 1 in open condition.
Figure 4:
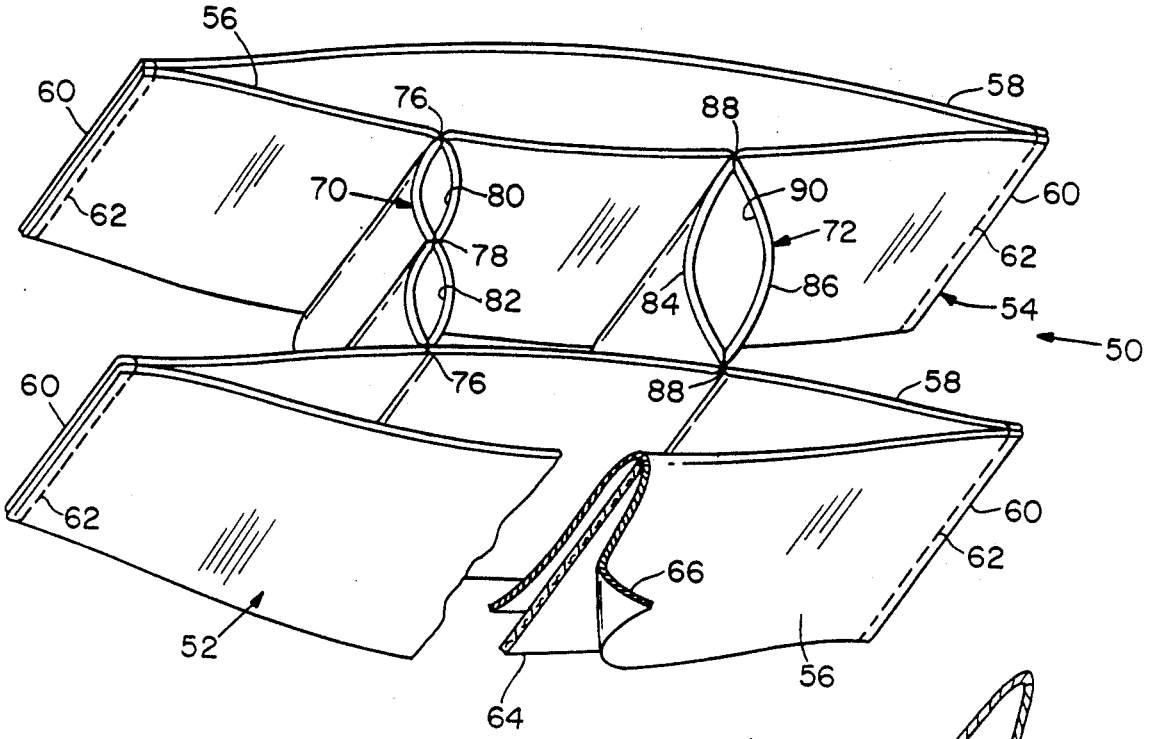
FIG. 4 is a perspective view, with parts broken away, of the removable organizer structure of the travel case of FIGS. 1–3.
Figure 3:
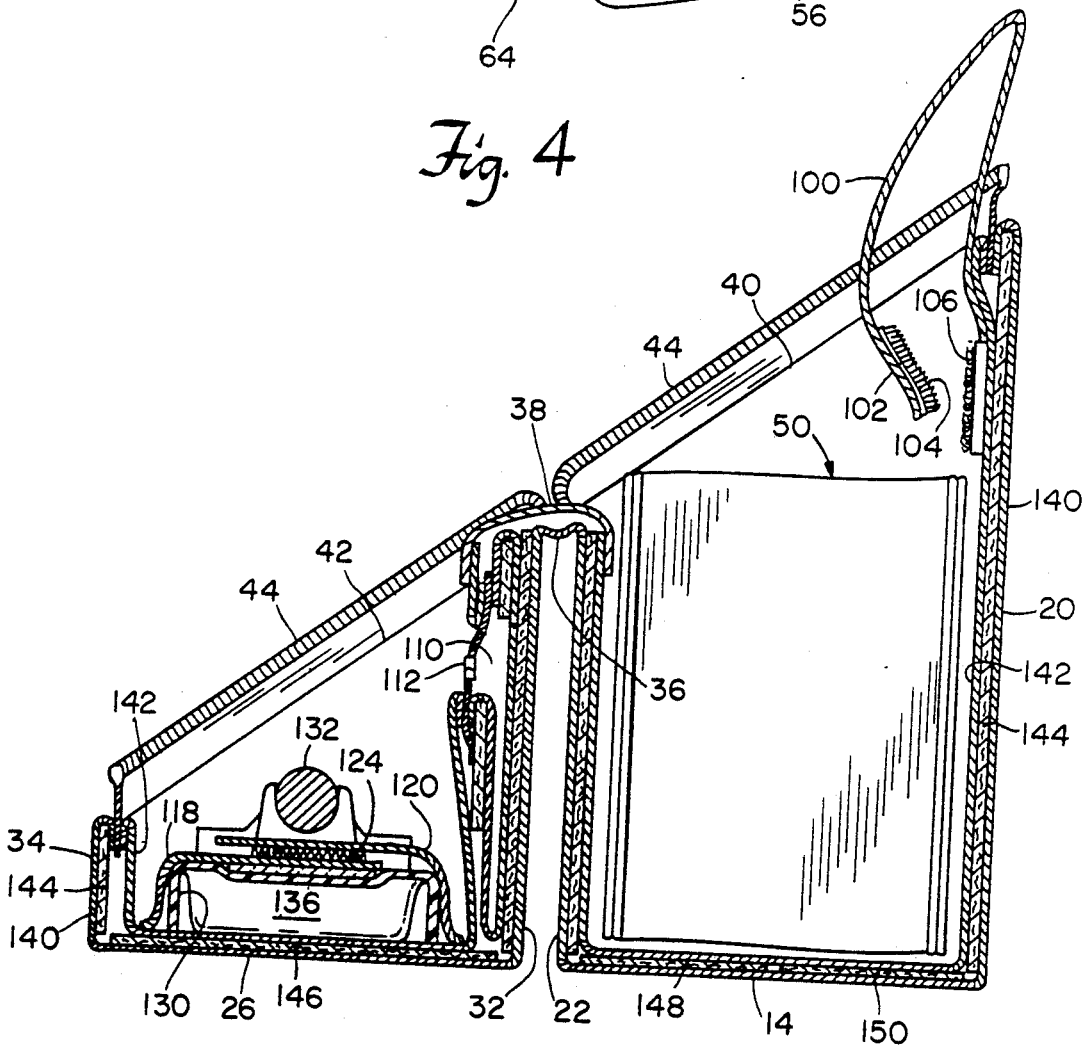
FIG. 3 is a sectional view showing the travel case of FIG. 1 in open condition.

Further details of the travel case 10 may be seen from FIGS. 2 and 3 which show the travel case in open condition. As shown in those Figures and in FIG. 4, removable organizer structure 50 is received in base portion 12 and includes spaced front and rear generally planar portions 52, 54, each of which includes two parallel strips 56, 58 that are secured together at their ends 60 by stitching 62 to provide a compartment for receiving a toiletries article. Each sheet portion 56, 58 includes cardboard sizing stiffener member 64 and fabric cover material 66. Interconnecting the front and rear portions 52, 54 are transverse portions 70, 72, transverse portion 70 being made of two pieces of sheet material that are secured together by stitching 76 at their connections to sheets 56, 58 and by intermediate stitching 78 to provide two compartments 80, 82 for receiving small toiletries articles. Transverse portion 72 is similarly composed of sheets 84, 86 which are secured to members 56, 58 by stitching 88 and form compartment 90 that is larger than compartments 80 and 82.

As indicated in FIG. 2, lip balm 92 or a similar article may be stored in compartment 82; a toiletries product 94 may be stored in one end compartment between front and rear members 52, 54; an eleven ounce can 96 may be stored in the compartment at the opposite end of organizer 50; and comb 98 may be stored in the compartment provided by portion 54. Also disposed in base portion 12 is hanger strap structure 100 that has a width of about six centimeters and a length of about fourteen centimeters. Carried at its detachable end 102 is hook fastener structure 104 (of the Velcro type) which cooperates with loop fastener structure 106 on front wall 20. Strap 100 enables the open travel case to be secured on a towel bar 108 (FIG. 2) or similar support. Travel case, when opened, has bottom surface 14 aligned with top surface 26 as indicated in FIG. 3 so that the case may be placed on a table or shelf for convenient access to the toiletry components therein.

Cover portion 24 includes compartment 110 formed adjacent rear wall 32, as indicated in FIG. 3 that includes zipper closure 112 that stores an accessory such as nail file 116. Also disposed in the cover compartment are straps 118, 120 which have widths of about six centimeters and carry hook and loop fastener structure 124. Straps 118, 120 in a first configuration as indicated in FIGS. 2 and 3 secure carrier 130 of the Sensor brand razor system that includes handle 132 and cartridge 134 together with storage compartment 136 with additional razor cartridges 134 (FIG. 3). Cartridge storage tray 130 is of the type shown in Aprille U.S. Pat. No. 4,742,909 that stores razor blade cartridges 134 of the type shown in Jacobson Design Patent No. 290,050; and the storage tray 130 also frictionally retains razor handle 132 of the type shown in Jacobson U.S. Pat. No. 4,492,025. In a second strap configuration, strap 120 extends over handle 132 and is attached to strap 118 by fasteners 124 to secure the razor handle 132 as well as tray 130 in cover portion 24. The low front wall 34 of cover 24 permits ready access to and removal of razor handle 132 with attached cartridge 134 when case 10 is open, as indicated in FIGS. 2 and 3 while storage tray 130 remains secured in cover portion 24 by straps 118, 120.

The front and rear walls (20, 22, 32, 34) of base and cover portions 12 and 24 each include outer sheet member 140 which may be of leather or fabric, inner lining 142 and intermediate stiffener member 144 of cardboard sizing. A similar stiffener member 146 is in the top wall 26 of cover 24, and two stiffener members 148, 150 are in the bottom wall 14 of base portion 12 to allow flexing of that portion of the travel case.

The travel case provides compact organized storage of a razor system and related toiletries articles and presents those stored articles in convenient, accessible array when the case is open.

While a particular embodiment of the invention has been shown and described, various modifications thereof will be apparent to those skilled in the art and therefore it is not intended that the invention be limited to the disclosed embodiment or to details therefrom and departures may be made therefrom within the spirit and scope of the invention.

What is claimed is:

1. A travel case comprising a base portion that defines a first compartment, support structure in said base portion for securing the travel case on a support bar or the like;

organizer structure in said first compartment, said organizer structure having a plurality of chambers for receiving in frictionally secured relation a plurality of toiletry components of diverse shapes and sizes;

a cover portion that defines a second compartment, releasable securing structure in said second compartment for retaining a shaving system;

hinge structure connecting said base portion and said cover portion; and closure structure for holding said base and cover portions in juxtaposed relation when the case is closed.

2. The travel case of claim 1 wherein said base portion has a generally rectangular bottom wall, spaced generally parallel side walls, a front wall and a rear wall; said cover portion has a rectangular top wall portion, spaced generally parallel side walls corresponding to the spaced side walls of said base portion, a front wall and a rear wall; the side walls and front wall of said base portion having upper surfaces that correspond to lower surfaces of the side walls and front wall of said cover portion; and said closure structure holds corresponding surfaces of said side and front walls in juxtaposed relation.

3. The travel case of claim 2 wherein said rear wall of said cover portion includes compartment structure for receiving a toiletries accessory.

4. The travel case of claim 3 wherein said compartment structure in said rear wall includes zipper closure structure.

5. The travel case of claim 2 wherein the top surfaces of said side walls of said base portion are inclined at an angle greater than 30° to said bottom wall.

6. The travel case of claim 2 wherein said bottom wall has a width of about eight centimeters and a length of about twenty centimeters; and said rear wall portions are in aligned relation when said case is in closed configuration and the overall height of the aligned rear wall portions is about seventeen centimeters.

7. The toiletries case of claim 1 wherein said organizer structure in said first compartment includes spaced, generally planar portions, and spaced transverse portions interconnecting said front and rear portions, said spaced transverse portions providing a first compartment for receiving a first toiletries article therebetween, and each said transverse portion including at least one further compartment for receiving second and third toiletries articles different from the first toiletries article.

8. The travel case of claim 1 wherein said support structure and said retaining structure each includes a releasable strap member.

9. The travel case of claim 8 wherein each said strap member includes hook and loop fastener structure for releasably securing said strap in attached relation.

10. The travel case of claim 1 wherein said closure structure includes zipper structure for securing corresponding surfaces of said base and cover portions in juxtaposed relation.

11. The travel case of claim 1 and further including a shaving system retained by said releasable securing structure, said shaving system including a razor handle and storage structure that carries a plurality of razor cartridges.

12. The travel case of claim 11 wherein said base portion has a generally rectangular bottom wall, spaced generally parallel side walls, a front wall and a rear wall; said cover portion has a rectangular top wall portion, spaced generally parallel side walls corresponding to the spaced side walls of said base portion, a front wall and a rear wall; the side walls and front wall of said base portion having upper surfaces that correspond to lower surfaces of the side walls and front wall of said cover portion; and said closure structure holds corresponding surfaces of said side and front walls in juxtaposed relation.

13. The toiletries case of claim 12 wherein said organizer structure in said first compartment is removable therefrom and includes spaced, generally planar portions, and spaced transverse portions interconnecting said front and rear portions, said spaced transverse portions providing a first compartment for receiving a first toiletries article therebetween, each said transverse portion including at least one further compartment for receiving second and third toiletries articles different from the first toiletries article; and each of said front and rear portions including at least one compartment for receiving a toiletries article of shape different from said first, second and third toiletries articles.

14. The travel case of claim 12 wherein said support structure and said retaining structure each includes a releasable strap member.

15. The travel case of claim 14 wherein each said strap member includes hook and loop fastener structure for releasably securing said strap in attached relation.

16. The travel case of claim 14 wherein said releasable strap member of said retaining structure retains said storage structure, and said razor handle is releasably secured to said storage structure for removal from said travel case while said storage structure remains retained in said cover portion against the inner surface of said top wall portions.

17. The travel case of claim 14 wherein said closure structure includes zipper structure for securing corresponding surfaces of said base and cover portions in juxtaposed relation.

18. The travel case of claim 14 wherein the top surfaces of said side walls of said base portion are inclined at an angle greater than 30° to said bottom wall.

19. The travel case of claim 18 wherein said rear wall of said cover portion includes compartment structure for receiving a toiletries accessory, said compartment structure including zipper closure structure; said storage structure includes a storage tray, said releasable strap member of said retaining structure retains said storage tray, and said razor handle is releasably secured to said storage tray for removal from said travel case while said storage tray remains retained in said cover portion against the inner surface of said top wall portion by said releasable strap member.

20. The travel case of claim 19 wherein said bottom wall has a width of about eight centimeters and a length of about twenty centimeters; said rear walls are in aligned relation when said case is in closed configuration; the overall height of the aligned rear walls is about seventeen centimeters; and the height of said front wall of said cover portion is less than about three centimeters.

* * * * *